United States Patent [19]

Engelhardt et al.

[11] 4,300,903

[45] Nov. 17, 1981

[54] PADDING AUXILIARIES AND PROCESSES FOR DYEING CELLULOSE FIBERS OR MIXTURES OF CELLULOSE FIBERS AND SYNTHETIC FIBERS WITH SULPHUR DYESTUFFS, SULPHUR VAT DYESTUFFS, VAT DYESTUFFS AND REACTIVE DYESTUFFS

[75] Inventors: Friedrich Engelhardt, Frankfurt am Main; Karl-Heinz Keil, Offenbach am Main; Gerhard Weckler, Sulzbach; Klaus Sternberger, Bad Vilbel, all of Fed. Rep. of Germany

[73] Assignee: Cassella Aktiengesellschaft, Frankfurt am Main, Fed. Rep. of Germany

[21] Appl. No.: 171,303

[22] Filed: Jul. 23, 1980

[30] Foreign Application Priority Data

Jul. 28, 1979 [DE] Fed. Rep. of Germany ..... 2930756

[51] Int. Cl.[3] ..... D06P 3/60; D06P 3/82

[52] U.S. Cl. ..... 8/531; 8/532; 8/543; 8/588; 8/591; 8/650; 8/652; 8/918

[58] Field of Search ..... 8/584, 586, 591, 650, 8/652, 543, 532, 918, 531, 588

[56] References Cited

U.S. PATENT DOCUMENTS

| | | | |
|---|---|---|---|
| 3,657,145 | 4/1972 | Manse et al. | 252/345 |
| 3,764,640 | 10/1973 | Klose | 260/928 |
| 4,012,463 | 3/1977 | Walsh et al. | 260/928 |
| 4,113,429 | 9/1978 | Kruse et al. | 8/584 |

*Primary Examiner*—A. Lionel Clingman
*Attorney, Agent, or Firm*—Connolly and Hutz

[57] ABSTRACT

A padding auxiliary is used in a dyeing process using a padding liquor wherein the padding auxiliary is an aqueous solution or dispersion containing (a) 20 to 50 percent by weight of a mixture of 50 to 100 percent by weight of a compound of the following formula

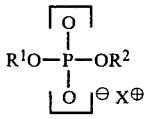

and 50 to 0 percent by weight of a compound of the following formula

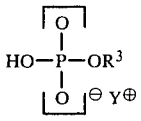

(b) b percent by weight of a compound of the formula

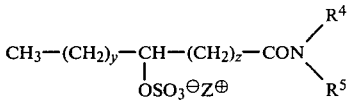

and (c) c percent by weight of a compound of the formula

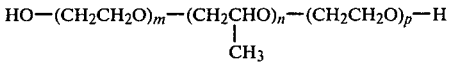

wherein b is a number from 0 to 5, c is a number from 0 to 5 and the numbers for b and c are chosen such that the sum of the numbers for b and c is a number from 1 to 10;

$R^1$, $R^2$ and $R^3$ are independently an aliphatic moiety with 5 to 12 carbon atoms or an araliphatic moiety with 7 to 13 carbon atoms;

$X\oplus$, $Y\oplus$ and $Z\oplus$ is each independently an alkali metal cation, ammonium cation or a cation of an alkylamine or hydroxyalkylamine wherein the alkyl has 1–12 carbon atoms;

$R^4$ is an aliphatic moiety with 1 to 8 carbon atoms, phenyl, alkylphenyl with 7 to 10 carbon atoms or phenylalkyl with 7 to 10 carbon atoms;

$R^5$ is hydrogen or an aliphatic moiety with 1 to 8 carbon atoms, phenyl, alkylphenyl with 7 to 10 carbon atom or phenylalkyl with 7 to 10 carbon atoms;

y and z are independently integers from 6 to 8;

n a number from 15 to 35;

m and p are the same number and their sum is a number from 2 to 120 with n and the sum of m and p being chosen such that $$\frac{(m+p)\cdot 44}{(m+p)\cdot 44 + n\cdot 58} = 0.1 \text{ to } 0.8.$$

11 Claims, No Drawings

PADDING AUXILIARIES AND PROCESSES FOR DYEING CELLULOSE FIBERS OR MIXTURES OF CELLULOSE FIBERS AND SYNTHETIC FIBERS WITH SULPHUR DYESTUFFS, SULPHUR VAT DYESTUFFS, VAT DYESTUFFS AND REACTIVE DYESTUFFS

The development of semi-continuous and completely continuous dyeing processes in which piece goods of woven fabrics and/knitted fabrics, yarns or slubbing are dyed has received increasing importance in recent years. Using these processes, it is possible to dye large meterages in the same colour shade with a considerable saving in costs. The difficulty in carrying out such dyeing processes is that of dyeing the material to be dyed with the same depth of colour and the same levelness at the start and at the end and from edge to edge. In order to obtain such a perfect dyeing in semi-continuous and completely continuous dyeing processes, it is necessary to use material which has been carefully pre-treated by boiling out and bleaching, which is, however, associated with a considerable expenditure of time and money.

The continuous dyeing processes consist of three process steps: padding, fixing and washing. In the first process step, that is to say padding, the pre-treated goods are immersed into a concentrated padding liquor which contains the dyestuff and auxiliary. This operation is preferably carried out in the temperature range from 10° to 20° C., that is to say at room temperature. Since the residence time of the goods in the padding liquor is only a few seconds at high running speeds, the goods must have a rapid and uniform affinity for the dyestuff. The padding is followed by fixing of the dyestuff, in which the dyestuff is fixed, onto the goods to be dyed, by heat treatment with hot air, steam or contact heat. As the last step, the non-fixed dyestuff is removed from the textile material by one or more washing processes.

There has been no lack of attempts to obtain the same depth of colour and same levelness at the edges and ends of the dyed textile material by using particular auxiliaries in the continuous dyeing processes. There is a need in industry, especially for the dyeing of untreated grey goods by a continuous dyeing process, to obtain a level meterage which is the same at the edges and ends by the addition of auxiliaries and without a further time-consuming pre-treatment.

Auxiliaries based on alkali metal salts of alkanesulphonates with a chain length of 10 to 20 C atoms and more than one sulphonic acid group in the molecule are thus frequently employed at present. However, when these compounds are employed in continuous dyeing processes, serious disadvantages are shown by this class of compounds at the present customary high running speeds, because too much foam is formed in the dye liquors, which contain a large quantity of electrolyte, and in the pH range above 8. In order to obtain perfect dyeings with these compounds, it is therefore absolutely necessary to incorporate additional anti-foaming agents in the dye liquor. Technologically, however, the use of anti-foaming agents involves the danger of its non-uniform distribution in the liquor, and formation of blotches on the goods thus as a rule cannot be excluded. At the same time, the use of anti-foaming agents is associated with additional costs and the danger of pollution of the effluent, this danger being considerable when anti-foaming agents based on silicones are used.

In addition to the compounds described above, the esters of monohydric alkanols with a branched or unbranched chain with 5 to 8 atoms, in the form of industrial grade mixtures of monoesters and diesters of orthophosphoric acid, are also employed. However, these products also have decisive disadvantages, since they also still form too much foam in the liquors, containing water-glass, in the pH range above 9 when reactive dyestuffs are used for the dyeing. The formation of foam and the stability of the foam has an adverse effect on the levelness of the dyeings and can give rise to the formation of blotches. Furthermore, the wetting times in the liquors containing hydrosulphite and electrolyte are also inadequate in the case of sulphur dyestuffs and vat dyestuffs.

It has now been found, surprisingly, that the disadvantages occurring hitherto are eliminated by using the padding auxiliary according to the invention.

The padding auxiliary, according to the invention, for dyeing cellulose fibres or cellulose fibre/synthetic fibre mixtures with sulphur dyestuffs, sulphur vat dyestuffs, vat dyestuffs or reactive dyestuffs, consists of an aqueous solution or dispersion containing (a) 20 to 50 percent by weight of a mixture of 50 to 100 percent by weight of a compound of the general formula Ia

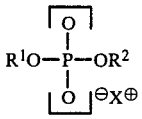

(Ia)

and 50 to 0 percent by weight of a compound of the general formula Ib

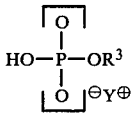

(Ib)

(b) b percent by weight of a compound of the general formula II

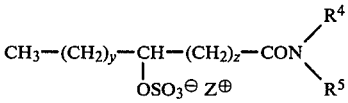

(II)

and (c) c percent by weight of a compound of the general formula III

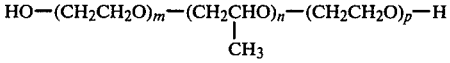

(III)

wherein b denotes a number from 0 to 5, c denotes a number from 0 to 5 and b and c are chosen such that (b+c) denotes a number from 1 to 10, and wherein $R^1$, $R^2$ and $R^3$ denote an aliphatic radical with 5 to 12 C atoms or an araliphatic radical with 7 to 13 C atoms, $X^{\oplus}$, $Y^{\oplus}$ and $Z^{\oplus}$ denote an alkali metal cation or ammonium cation or a cation of an alkylamine or hydroxyalkylamine, $R^4$ denotes an aliphatic radical with 1 to 8 C atoms, a phenyl group or an alkylphenyl group or phenylalkyl group with in each case 1 to 4 C atoms in the alkyl radical, $R^5$ denotes hydrogen or $R^4$, y and z denote integers from 6 to 8, (y+z) preferably being 15, n denotes a number from 15 to 35 and (m+p) denotes a number from 2 to 120, n and (m+p) being chosen such that $$\frac{(m+p)\cdot 44}{(m+p)\cdot 44 + n\cdot 58} = 0.1 \text{ to } 0.8.$$

The compounds of the general formula I are salts of orthophosphoric acid diesters and the compounds of the general formula Ib are salts of orthophosphoric acid monoesters. The proportion of diester Ia in the mixture of the compounds Ia and Ib must be at least 50 percent by weight, and the diester content in the mixture should preferably be more than 70 percent by weight. It is, of course, also possible to use only a diester of the general formula Ia (content of the diester in the mixture=100 percent by weight, content of the monoester in the mixture=0 percent by weight). Mixtures of compounds Ia with compounds Ib which contain at least 50 percent by weight of the diester Ia are obtainable as industrial products in which $R^1=R^2=R^3$ and $X^{\oplus}=Y^{\oplus}$. These industrial products can also contain 0 to 15 percent by weight of the alkanol ($R^1OH$) used for the esterification, but this does not interfere with the preparation of the padding auxiliary according to the invention.

$R^1$, $R^2$ and $R^3$ denote, in particular, alkyl radicals, preferably branched alkyl radicals with 7 to 10 C atoms, such as, for example, isooctyl, isononyl and isodecyl. If $R^1$, $R^2$ and $R^3$ represent an araliphatic radical, the benzyl radical is preferred.

An aliphatic radical represented by $R^4$ is, in particular, an alkyl radical with 1 to 5 C atoms. Examples of an alkylphenyl group represented by $R^4$ are: 2-, 3- or 4-methyl-, -ethyl- or -n-butyl-phenyl. If $R^4$ represents a phenalkyl group, the benzyl groupsis preferred.

In addition to an alkali metal cation or the ammonium cation, $X^{\oplus}$, $Y^{\oplus}$ and $Z^{\oplus}$ can also denote a monoalkyl-, dialkyl- or trialkyl-ammonium cation with 1 to 4 C atoms in the individual alkyl radicals or a mono-hydroxyalkyl-dialkyl-, dihydroxyalkyl-monoalkyl- or tri-hydroxyalkyl-ammonium cation, with 1 to 4 C atoms in the individual alkyl radicals. $X^{\oplus}$, $Y^{\oplus}$ and $Z^{\oplus}$ preferably represent $Na^{\oplus}$, $K^{\oplus}$, $NH_4^{\oplus}$, trimethylammonium or triethanolammonium. In many cases, $X^{\oplus}=Y^{\oplus}=Z^{\oplus}$.

Certain of the compounds Ia, Ib, II and III are commercially available. The compounds III are block copolymers of ethylene oxide and propylene oxide, m and p being the same in the statistical sense. Those compounds III in which $$\frac{(m+p)\cdot 44}{(m+p)\cdot 44 + n\cdot 58} = 0.1 \text{ to } 0.4,$$

that is to say in which the proportion by weight of ethylene oxide is 10 to 40 percent by weight, are preferably employed.

The padding auxiliaries according to the invention can be prepared in a simple manner by a process in which the mixture of compounds (Ia+Ib) and the compound II and/or III are stirred into water in the weight ratios indicated. Instead of the diester salts of the general formula Ia or the monoester salts of the general formula Ib, it is also possible to use the free diester-acids or monoester-acids of the general formula Ic or Id

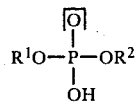

Ic

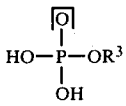

Id to prepare the padding auxiliary. The pH value of the resulting solution or dispersion is then adjusted to above 7, preferably to values of 7 to 8, with alkali metal hydroxides, ammonia or organic amines. Sodium hydroxide solution or potassium hydroxide solution, aqueous ammonia solution or triethanolamine are preferably used to adjust the pH value.

The padding auxiliary according to the invention is employed for dyeing cellulose fibres or cellulose fibre/-synthetic fibre mixtures with sulphur dyestuffs, sulphur vat dyestuffs, vat dyestuffs, or reactive dyestuffs by continuous, semi-continuous or discontinuous dyeing processes, in amounts of 1 to 40 g/l of dye liquor, preferably in amounts of 1 to 15 g/l of dye liquor. As a rule, dyeing is carried out with liquor ratios of between 1:2 and 1:30, preferably between 1:2 and 1:12. The dyeing process according to the invention can, of course, also be carried out by a procedure in which, instead of the ready-to-use padding auxiliary, the active substances given under (a), (b) and (c) are added to the dye liquor in total amounts of 0.2 to 24 g/l, preferably 0.2 to 9 g/l. 83.5 to 95 percent by weight of the active substances given under (a), 0. to 8.25 percent by weight of the active substances given under (b) and 0 to 8.25 percent by weight of the active substances given under (c) are required in this procedure, the values of (b) and (c) being chosen such that the sum of the active substances given under (b) and (c) is 5 to 16.5 percent by weight.

The padding auxiliaries according to the invention which are used for dyeing with sulphur dyestuffs, sulphur vat dyestuffs and vat dyestuffs preferably contain none of the compounds III given under (c).

The padding auxiliaries according to the invention which are used for dyeing with reactive dyestuffs preferably contain none of the compounds II given under (b).

The actual dyeing operation is carried out in the customary manner, even in the case of dyeing processes with long liquor ratios, after adding the padding auxiliary according to the invention or the abovementioned active substance combination to the dye liquor. Dyeing can be carried out, for example, by the pad-steam process, Williams unit process, cold batch process, pad-jig process or pad-roll process. Continuous dyeing processes can be carried out with or without intermediate drying after the padding.

All the known modifications of sulphur dyestuffs can be used. Suitable sulphur dyestuffs are, for example, the following: C.I. Sulphur Blue 1, C.I. Leuco Sulphur Blue 1, C.I. Sulphur Blue 3, C.I. Leuco Sulphur Blue 3, C.I. Sulphur Blue 4, C.I. Solubilised Sulphur Blue 4, C.I. Sulphur Blue 5, C.I. Leuco Sulphur Blue 5, C.I. Solubilised Sulphur Blue 5, C.I. Sulphur Blue 7, C.I. Leuco Sulphur Blue 7, C.I. Solubilised Sulphur Blue 7, C.I. Sulphur Blue 10, C.I. Solublised Sulphur Blue 10, C.I. Sulphur Blue 15, C.I. Leuco Sulphur Blue 15, C.I. Solubilised Sulphur Blue 15, C.I. Sulphur Yellow 2, C.I.

Leuco Sulphur Yellow 2, C.I. Solubilised Sulphur Yellow 2, C.I. Sulphur Yellow 4, C.I. Leuco Sulphur Yellow 4, C.I. Solubilised Sulphur Yellow 4, C.I. Leuco Sulphur Yellow 7, C.I. Sulphur Yellow 9, C.I. Leuco Sulphur Yellow 9, C.I. Sulphur Green 2, C.I. Leuco Sulphur Green 2, C.I. Solubilised Sulphur Green 2, C.I. Sulphur Green 3, C.I. Leuco Sulphur Green 3, C.I. Solubilised Sulphur Green 3, C.I. Sulphur Green 5, Sulphur Brown 5, C.I. Leuco Sulphur Brown 5, C.I. Solubilised Sulphur Brown 5, C.I. Sulphur Brown 10, C.I. Leuco Sulphur Brown 10, C.I. Sulphur Brown 16, C.I. Solubilised Sulphur Brown 16, C.I. Sulphur Brown 51, C.I. Solubilised Sulphur Brown 51, C.I. Sulphur Black 8, C.I. Sulphur Red 3, C.I. Solubilised Sulphur Red 3, C.I. Sulphur Red 7 and C.I. Solubilised Sulphur Red 7.

Suitable sulphur vat dyestuffs are, for example, C.I. Vat Blue 42, C.I. Reduced Vat Blue 42, C.I. Vat Blue 43, C.I. Reduced Vat Blue 43, C.I. Vat Blue 44, C.I. Vat Blue 45, C.I. Vat Blue 47, Vat Blue 49, C.I. Vat Blue 50, C.I. Sulphur Black 10 and C.I. Leuco Sulphur Black 10.

Suitable vat dyestuffs are, for example, C.I. Vat Orange 7, C.I. Vat Red 13, C.I. Vat Red 14, C.I. Vat Red 15, C.I. Vat Brown 1, C.I. Vat Brown 3, C.I. Vat Blue 13, C.I. Vat Blue 16, C.I. Vat Violet 1 and C.I. Vat Blue 4:1.

Suitable reactive dyestuffs are, for example, C.I. Reactive Yellow 17, C.I. Reactive Orange 7, C.I. Reactive Orange 16, C.I. Reactive Red 22, C.I. Reactive Red 23, C.I. Reactive Blue 5, C.I. Reactive Blue 19, C.I. Reactive Violet 4 and C.I. Reactive Violet 5.

Materials containing cellulose fibres or materials of cellulose fibre/synthetic fibre mixtures which have or have not been pre-treated can be used as the textile materials. Mixtures such as cotton/polyester, viscose staple/polyester, cotton/polyamine and polyamide/viscose staple are used in particular.

Perfect dyeings with the same depth of colour from edge to edge and from the start to finish are achieved by the dyeing process according to the invention and by using the padding auxiliary according to the invention. The synergistic shortening of the wetting times achieved by the active substance combination according to the invention and the reduction in the volume of foam can be seen from the following tables.

Percentages given in the tables and examples are percentages by weight and the parts are parts by weight, unless otherwise indicated. Furthermore, the meanings of the terms are as follows:

Liquor 1: a dye liquor for dyeing with sulphur dyestuffs, sulphur vat dyestuffs and vat dyestuffs by the pad-steam process, which contains 50 g of NaOH of 32° Bé strength and 40 g of $NaHSO_3$ per liter.

Liquor 2: a dye liquor for dyeing with sulphur dyestuffs, sulphur vat dyestuffs and vat dyestuffs by the pad-steam process, which contains 50 g of NaOH of 32° Bé strength, 40 g of $NaHSO_4$ and 20 g of NaCl per liter.

Liquor 3: a liquor for dyeing with reactive dyestuffs, which contains 125 g of water-glass, 30 g of NaOH of 38° Bé strength and 20 g of $Na_2SO_4$ per liter.

Liquor 4: a liquor for dyeing with reactive dyestuffs, which contains 125 g of water-glass, 30 g of NaOH of 38° Bé strength, 20 g of $Na_2SO_4$ and 100 g of urea per liter.

Liquor 5: a liquor for dyeing with reactive dyestuffs, which contains 20 g of NaOH of 38° Bé strength, 30 g of NaCl and 20 g of $Na_2SO_4$ per liter.

Liquor 6: a liquor for dyeing with reactive dyestuffs, which contains 20 g of NaOH of 38° Bé strength, 30 g of NaCl, 20 g of $Na_2SO_4$ and 100 g of urea per liter.

A 1: the triethanolamine salt of mono-benzyl phosphate.

A 2: the triethanolamine salt of di-benzyl phosphate.

A 3: the potassium salt of di-(2-ethyl-hexyl) phosphate.

A 4: the potassium salt of mono-(2-ethyl-hexyl) phosphate.

$$CH_3-(CH_2)_7-\underset{\underset{OSO_3^{\ominus}Na^{\oplus}}{|}}{CH}-(CH_2)_8-CO-\underset{\underset{CH_3}{|}}{N}-C_6H_5: \qquad D1$$

$$CH_3-(CH_2)_7-\underset{\underset{OSO_3^{\ominus}Na^{\oplus}}{|}}{CH}-(CH_2)_8-CO-\underset{\underset{C_4H_{9(n)}}{|}}{N}-C_4H_{9(n)}: \qquad D2$$

$$CH_3-(CH_2)_7-\underset{\underset{OSO_3^{\ominus}Na^{\oplus}}{|}}{CH}-(CH_2)_8-CO-\underset{\underset{CH_3}{|}}{N}-CH_3: \qquad D3$$

C 1: an ethylene oxide/propylene oxide block copolymer with a molecular weight of less than 2,000 and an ethylene oxide content of 10 percent by weight (compound III, in which $$\frac{44(m+p)}{44(m+p)+58n} = 0.1).$$

C 2: an ethylene oxide/propylene oxide block copolymer with a molecular weight of less than 3,500 and an ethylene oxide content of 40 percent by weight (compound III, in which $$\frac{44(m+p)}{44(m+p)+58n} = 0.4).$$

The wetting times were determined using the method described in DIN Specification 53,901; the foam values were determined in accordance with the method of DIN Specification 53,902.

Padding auxiliaries according to the invention are given under the No. 1 in Tables I to IV and under the Nos. V/1 and V/4 to 6 Table V. As can also be seen from Tables IV and V, the padding auxiliaries according to the invention give surprisingly stable padding liquors for sulphur dyestuffs, sulfur vat dyestuffs and vat dyestuffs. The fact that the ionic auxiliary in the combination according to the invention does not have a flocculating action even though the liquor is strongly alkaline and has a high electrolyte content was surprising.

The use of the padding auxiliaries according to the invention is described in more detail in the following examples.

EXAMPLE 1

A greige cotton moleskin which is difficult to penetrate by dyeing and a greige tarpaulin fabric are padded with a liquor which contains 30 g/l of Hydron-Blau Rf. Sol (Vat Blue, C.I. 53630), 50 ml/l of sodium hydroxide solution of 32° Be strength, 40 g/l of hydrosulphite and 4 g/l of an auxiliary formulation consisting of 16 parts of mono-(2-ethylhexyl) phosphate and 24 parts of di-(2-ethylhexyl) phosphate, in each case the potassium salt, and 2.5 parts of 10-hydroxyoctadecanecarboxylic acid di-n-butylamide, as the Na⊕ salt of the sulphuric acid half-ester.

TABLE I/II

| No. | Auxiliary formulation | Wetting times in seconds at 10 g of active substance/1 liter of liquor: Liquor 1 | Liquor 2 | Liquor 3 | Liquor 4 | Liquor 5 | Liquor 6 |
|---|---|---|---|---|---|---|---|
| I/1 | 5% of A 4<br>35% of A 3<br>5% of C 2<br>Remainder:water | 10 | 11 | 20 | 25 | 4 | 15 |
| I/2 | 5% of A 4<br>35% of A 3<br>Remainder:water | 22 | 17 | 40 | 60 | 10 | 44 |
| I/3 | 100% of D 2 | 70 | 114 | 76 | 131 | 52 | 55 |
| I/4 | 100% of C 2 | 00 | 00 | 00 | 00 | 00 | 00 |
| II/1 | 5% of A 1<br>35% of A 2<br>5% of C 1<br>Remainder:water | 8 | 10 | 20 | 28 | 6 | 12 |
| II/2 | 5% of A 1<br>35% of A 2<br>Remainder:water | 28 | 19 | 40 | 60 | 20 | 50 |
| II/3 | 35% of D 1<br>Remainder:water | 90 | 140 | 85 | 150 | 70 | 72 |
| II/4 | 100% of C 1 | 00 | 00 | 00 | 00 | 00 | 00 |

TABLE III

| No. | Auxiliary formulation | Wetting time in seconds at 4 g of active substance/1 liter of liquor: Liquor 1 | Liquor 2 | Liquor 3 | Liquor 4 | Liquor 5 | Liquor 6 |
|---|---|---|---|---|---|---|---|
| 1 | 16% of A 4<br>24% of A 3<br>5% of C 1<br>Remainder:water | 11 | 15 | 30 | 43 | 14 | 24 |
| 2 | 16% of A 4<br>24% of A 3<br>Remainder:water | 16 | 20 | 36 | 53 | 19 | 32 |
| 3 | 100% of D 2 | 70 | 114 | 76 | 131 | 52 | 55 |
| 4 | 100% of C 1 | 00 | 00 | 00 | 00 | 00 | 00 |

TABLE IV/V

Foam values in ml, measured at the start (a), after 1 minute (b) and after 3 minutes (c), for auxiliary formulations IV at 6 g of active substance/1 liter of dye liquor and for auxiliary formulation V at 4 g of active substance/1 liter of dye liquor.

| No. | Auxiliary formulation | Liquor 2 | | Liquor 4 | | Stability of the liquor 2 in the presence of a sulphur dyestuff |
|---|---|---|---|---|---|---|
| IV/1 | 20% of A 1<br>20% of A 2<br>1% of D 2<br>2,5% of C 1<br>Remainder: water | (a)<br>(b) | 0<br>0 | (a)<br>(b) | 10<br>0 | 40 hours |
| IV/2 | 20% of A 1<br>20% of A 2<br>5% of C 1<br>Remainder: water | (a)<br>(b) | 15<br>0 | (a)<br>(b) | 15<br>0 | 1,5 hours |
| IV/3 | 20% of A 1<br>20% of A 2<br>Remainder: water | (a)<br>(b) | 50<br>0 | (a)<br>(c) | 270<br>0 | 16 hours |
| V/1 | 20% of A 4<br>20% of A 3<br>1% of D 3<br>4% of C 1<br>Remainder: water | (a)<br>(b) | 0<br>0 | (a)<br>(b) | 100<br>10 | 24 hours |

TABLE IV/V-continued

Foam values in ml, measured at the start (a), after 1 minute (b) and after 3 minutes (c), for auxiliary formulations IV at 6 g of active substance/1 liter of dye liquor and for auxiliary formulation V at 4 g of active substance/1 liter of dye liquor.

| No. | Auxiliary formulation | Liquor 2 | | Liquor 4 | | Stability of the liquor 2 in the presence of a sulphur dyestuff |
|---|---|---|---|---|---|---|
| V/2 | 20% of A 4<br>20% of A 3<br>5% of C 1<br>Remainder: water | (a)<br>(b) | 10<br>0 | (a)<br>(b) | 70<br>0 | 1 hour |
| V/3 | 20% of A 4<br>20% of A 3<br>Remainder: water | (a)<br>(b) | 20<br>0 | (a)<br>(b) | 230<br>150 | 12 hours |
| V/4 | 10% of A 4<br>20% of A 3<br>2,5% of D 2<br>Remainder: water | (a)<br>(b) | 10<br>0 | | | 12 hours |
| V/5 | 10% of A 4<br>20% of A 3<br>0,5% of D 2<br>2% of C 1<br>Remainder: water | (a)<br>(b) | 5<br>0 | | | 24 hours |
| V/6 | 10% of A 4<br>20% of A 3<br>1% of D 2<br>4% of C 1<br>Remainder: water | (a)<br>(b) | 0<br>0 | | | 24 hours |

The padding temperature is about 20° C. The liquor pick-up of the two-bowl padder used is 55% in the case of the cotton moleskin and 47% in the case of the cotton tent fabric. After padding and steaming, and finishing the dyeings on an open-width washing machine by rinsing, oxidising and rinsing again, dyeings which have penetrated well and have perfect levelness are obtained.

EXAMPLE 2

The greige cotton moleskin of Example 1 is padded with a liquor which contains 25 g/l of Indanthren-Gelb F 2 GC Colloisol (Vat Yellow 33) and 4 g/l of a padding auxiliary consisting of 5 parts of mono-(2-ethylhexyl) phosphate and 35 parts of di-(2-ethylhexyl) phosphate, in each case the potassium salt, and 5 parts of an ethylene oxide/propylene oxide copolymer with a molecular weight of less than 2,000 and an ethylene oxide content of 10%, and is then dried in a hot flue at 120° to 140° C., impregnated, in a chemical trough, with a liquor containing 60 ml/l of sodium hydroxide solution of 38° Bé strength and 30 g/l of hydrosulphite and steamed and the dyeing is finished on an open-width washing machine by rinsing, oxidising, soaping at the boil and rinsing again. A perfect dyeing is obtained.

EXAMPLE 3

A greige tarpaulin fabric is padded with a liquor which contains 80 g/l of Cassulfon-Lichtbraun GGL, liquid (Solubilised Sulphur Brown 51, C.I. 53328) and 4 g/l of a padding auxiliary consisting of 16 parts of mono-(2-ethylhexyl) phosphate and 24 parts of di-(2-ethylhexyl) phosphate, in each case the triethanolamine salt, and 5 parts of the sodium salt of the sulphuric acid half-ester of 10-hydroxyoctadecanoic acid N-methylanilide, and then dried in a hot flue at 120° to 140° C., impregnated, in a chemical trough, with a liquor which contains 12 g/l of sodium carbonate, 40 ml/l of Sulfhydrat F 150 (commercial product of Cassella AG, Frankfurt/Main-61) and 3 ml/l of Stabilisal S, liquid (commercial product of Cassella AG, Frankfurt-/Main-61) and steamed and the dyeing is finished on an open-width washing machine by rinsing, oxidising and rinsing again. A perfect dyeing is obtained.

EXAMPLE 4

A greige tarpaulin fabric is padded with a liquor which contains 30 g/l of Indocarbon CL für Sol (Sulphur Black 11, C.I. 53290) and 4 g/l of a padding auxiliary consisting of 5 parts of mono-(2-ethylhexyl) phosphate and 35 parts of di-(2-ethylhexyl) phosphate, in each case the potassium salt, 0.5 part of the sodium salt of the sulphuric acid half-ester of 10-hydroxyoctadecanecarboxylic acid di-n-butylamide and 2 parts of an ethylene oxide/propylene oxide copolymer with a molecular weight of less than 3,500 and with an ethylene oxide content of 40% by weight, and the dyeing is developed in a jig with sodium hydroxide solution and hydrosulphite, without drying or after drying in a hot flue, and is finished by rinsing and oxidising. A perfect dyeing is obtained.

EXAMPLE 5

A greige cotton moleskin is padded with a liquor which contains 25 g/l of Indanthren-Brillantorange RK Colloisol (Vat Orange 3, C.I. 59300) and 4 g/l of a padding auxiliary consisting of 16 parts of mono-(2-ethylhexyl) phosphate and 24 parts of di-(2-ethylhexyl) phosphate, in each case the sodium salt, 1 part of the sodium salt of the sulphuric acid half-ester of 10-hydroxyoctadecanecarboxylic acid di-n-butylamide and 4 parts of an ethylene oxide/propylene oxide copolymer with a molecular weight of less than 2,000 and with a content of ethylene oxide of 10% by weight, and is further processed as indicated in Example 4. A perfect dyeing is obtained.

EXAMPLE 6

A greige cotton moleskin is padded with a liquor which contains 40 g/l of Hydrosol-Lichtbraun GGL and 4 g/l of a padding auxiliary consisting of 20 parts of mono-benzyl phosphate and 20 parts of di-benzyl phosphate, in each case the triethanolamine salt, and 2.5 parts of the sodium salt of the sulphuric acid half-ester of 10-hydroxy-octadecanecarboxylic acid di-n-butylamide, and the dyeing is developed in a jig with sodium carbonate, Sulfhydrat F 150 and Stabilisal S, liquid, without drying or after drying in a hot flue, and is finished by rinsing and oxidising. A perfect dyeing is obtained.

EXAMPLE 7

A cotton yarn is dyed, at 50° C., with a liquor which contains 1.5% of Indanthren-Rotbraun RR Colloisol (Vat Brown 45, C.I. 59500), 10 ml/l of sodium hydroxide solution of 38° Bé strength, 4 g/l of hydrosulphite, 10 g/l of NaCl and 1 g/l of a padding auxiliary consisting of 16 parts of mono-(2-ethylhexyl) phosphate and 24 parts of di-(2-ethylhexyl) phosphate, in each case the potassium salt, and 5 parts of an ethylene oxide/propylene oxide copolymer with a molecular weight of less than 2,000 and an ethylene oxide content of 10%, and the dyeing is finished by oxidation and soaping at the boil. Cotton yarns on which the dyeing is level and has penetrated well are obtained.

EXAMPLE 8

Cotton yarn is dyed, at 70° C., with a liquor which contains 1% of Hydron-Blau RB powder, highly concentrated (Vat Blue 43, C.I. 53630) and 1 g/l of a padding auxiliary consisting of 16 parts of mono-(2-ethylhexyl) phosphate and 24 parts of di-(2-ethylhexyl) phosphate, in each case the potassium salt, and 2.5 parts of the sodium salt of the sulphuric acid half-ester of 10-hydroxyoctadecanecarboxylic acid di-n-butylamide, as well as the chemicals indicated in Example 7. The dyeing is finished as in Example 7.

EXAMPLE 9

Cotton yarn is dyed, at 90° C., in a liquor which contains 6% of Immedial Carbon CMR, highly concentrated granules (Sulphur Black 1, C.I. 53185), 7 g/l of sodium carbonate, 10 ml/l of Sulfhydrat F 150 (commercial product of Cassella AG, Frankfurt/Main-61), 2 ml/l of Stabilisal S, liquid (commercial product of Cassella AG, Frankfurt/Main-61), 10 g/l of sodium chloride and 1 g/l of a padding auxiliary prepared from 20 parts of mono-(isononyl) phosphate and 20 parts of di-(isononyl) phosphate, in each case the potassium salt, and 4.0 parts of 10-hydroxyoctadecanecarboxylic acid N-butylamide, and the dyeing is finished by oxidation and rinsing. A cotton yarn on which the dyeing has penetrated perfectly is obtained.

EXAMPLE 10

Easy-care cotton twill is padded, at 22° to 25° C. on a padder, with a liquor which contains 60 g/l of Remazol Rot B (Reactive Red 22, C.I. 14824), 35 ml/l of sodium hydroxide solution of 38° Bé strength, 95 ml/l of sodium water-glass of 38° Bé strength and 4 g/l of a padding auxiliary consisting of 5 parts of potassium mono-(2-ethylhexyl) phosphate, 3.5 parts of potassium di-(2-ethylhexyl) phosphate, 0.5 part of the sodium salt of the sulphuric acid half-ester of 10-hydroxyoctadecanecarboxylic acid di-n-butylamide and 2 parts of an ethylene oxide/propylene oxide copolymer with a molecular weight of less than 3,500 and an ethylene oxide content of 40% by weight, and is batched up and left for 4 hours. The dyeing is then finished in the customary manner by rinsing at 70° C., soaping at the boil and rinsing again hot and cold. A perfect dyeing which has penetrated well is obtained.

EXAMPLE 11

Easy-care knitted cotton fabric is padded, on a padder, with a liquor which contains 30 g/l of Remazol Goldgelb G (Reactive Yellow 17, C.I. 18852), 14 ml/l of sodium hydroxide solution of 38° Bé strength, 30 g/l of sodium chloride and 6 g/l of a padding auxiliary prepared from 16 parts of potassium mono-(2-ethylhexyl) phosphate, 24 parts of potassium di-(2-ethylhexyl)-phosphate, and 5 parts of an ethylene oxide/propylene oxide copolymer with a molecular weight of less than 2,000 and with an ethylene oxide content of 10%, and is batched up and left for 12 hours. The dyeing is then rinsed cold, neutralised at 40° C. with acetic acid, rinsed hot, soaped at the boil and finished by cold and hot rinsing. A dyeing with perfect levelness is obtained.

What is claimed is:

1. Padding auxiliary for dyeing cellulose or cellulose fiber/synthetic fiber mixtures with sulphur dyestuffs, sulphur vat dyestuffs, vat dyestuffs or reactive dyestuffs, said auxiliary comprising an aqueous solution or dispersion containing (a) 20 to 50 percent by weight of a mixture of 50 to 100 percent by weight of a compound of the following formula (Ia)

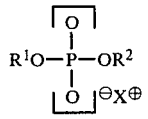

(Ia)

and 50 to 0 percent by weight of a compound of the following formula (Ib)

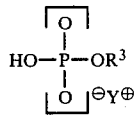

(Ib)

(b) b percent by weight of a compound of the formula

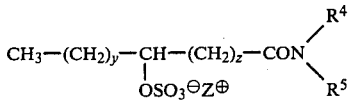

and (c) c percent by weight of a compound of the formula

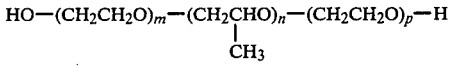

wherein b is a number from 0 to 5, c is a number from 0 to 5 and the numbers for b and c are chosen such that the sum of the numbers for b and c is a number from 1 to 10;

$R^1$, $R^2$ and $R^3$ are independently an aliphatic moiety with 5 to 12 carbon atoms or an araliphatic moiety with 7 to 13 carbon atoms;

$X^{\oplus}$, $Y^{\oplus}$ and $Z^{\oplus}$ is each independently an alkali metal cation, ammonium cation or a cation of an alkylamine or hydroxyalkylamine wherein the alkyl has 1–12 carbon atoms;

$R^4$ is an aliphatic moiety with 1 to 8 carbon atoms, phenyl, alkylphenyl with 7 to 10 carbon atoms or phenylalkyl with 7 to 10 carbon atoms;

$R^5$ is hydrogen or an aliphatic moiety with 1 to 8 carbon atoms, phenyl, alkylphenyl with 7 to 10 carbon atoms or phenylalkyl with 7 to 10 carbon atoms;

y and z are independently integers from 6 to 8;

n a number from 15 to 35;

m and p are the same number and their sum is a number from 2 to 120 with n and the sum of m and p being chosen such that $$\frac{(m+p)\cdot 44}{(m+p)\cdot 44 + n\cdot 58} = 0.1 \text{ to } 0.8.$$

2. Padding auxiliary according to claim 1, wherein the mixture of compounds Ia and Ib contains at least 70 percent by weight of compound Ia.

3. Padding auxiliary according to claim 1 wherein the compound of component (c) has n, m and p defined by $$\frac{44\cdot(m+P)}{44(m+p)+58\,n} = 0.1 \text{ to } 0.4$$

4. Padding auxiliary according to claim 1 wherein $R^1$, $R^2$ and $R^3$ are independently alkyl with 5 to 12 carbon atoms or aralkyl with 7 to 13 carbon atoms; $R^4$ is alkyl with 1 to 8 carbon atoms or benzyl; and $R^5$ is hydrogen, alkyl with 1 to 8 carbon atoms or benzyl.

5. Padding auxiliary according to claim 1 wherein $R^1$, $R^2$ or $R^3$ are independently a branched alkyl with 7 to 10 carbon atoms.

6. Padding auxiliary according to claim 1 wherein the sum of y and z is 15.

7. In the process for dyeing cellulose fibers or cellulose fiber synthetic fiber mixtures with sulphur dyestuffs, sulphur vat dyestuffs, vat dyestuffs or reactive dydstuffs using a padding liquor, the improvement comprises adding to the padding liquor employed 1 to 40 g/l of a padding auxiliary according to claim 1.

8. The process according to claim 7 wherein 1 to 15 g/l of padding auxiliary is added to the padding liquor.

9. In the process for dyeing cellulose fibers or cellulose fiber/synthetic fiber mixtures with sulphur dyestuffs, sulphur vat dyestuffs, vat dyestuffs or reactive dyestuffs using a padding liquor, the improvement comprises adding to the padding liquor 0.2 to 9 g/l of a padding auxiliary according to claim 1 wherein the padding auxiliary contains in aqueous solution a mixture of 83.5 to 95 percent by weight of component (a), 0 to 8.25 percent by weight of component (b) and 0 to 8.25 percent by weight of component (c) with the sum of components (a), (b) and (c) being 100 percent.

10. Padding auxiliary according to claim 1 used for dyeing with sulphur dyestuffs, sulphur vat dyestuffs and vat dyestuffs wherein the number for the symbol c is zero.

11. Padding auxiliary according to claim 1 used for dyeing with reactive dyestuffs wherein the number for the symbol b is zero.

* * * * *